United States Patent [19]

Sakitani et al.

[11] 4,434,844

[45] Mar. 6, 1984

[54] CROSS-FIN COIL TYPE HEAT EXCHANGER

[75] Inventors: Katsumi Sakitani, Kawachinagano; Shigehiro Uemura; Ryuzaburo Yajima, both of Sakai, all of Japan

[73] Assignee: Daikin Kogyo Co., Ltd., Osaka, Japan

[21] Appl. No.: 289,978

[22] Filed: Aug. 4, 1981

[30] Foreign Application Priority Data

| | | | |
|---|---|---|---|
| May 15, 1981 | [JP] | Japan | 56-70724[U] |
| May 29, 1981 | [JP] | Japan | 56-82986 |
| Jul. 16, 1981 | [JP] | Japan | 56-111770 |
| Jul. 16, 1981 | [JP] | Japan | 56-111771 |

[51] Int. Cl.[3] ..... F28F 1/32

[52] U.S. Cl. ..... 165/151; 165/133

[58] Field of Search ..... 165/151, 133

[56] References Cited

FOREIGN PATENT DOCUMENTS

| | | | |
|---|---|---|---|
| 954282 | 9/1974 | Canada | 165/151 |
| 1958909 | 6/1971 | Fed. Rep. of Germany | 165/151 |
| 2518226 | 11/1975 | Fed. Rep. of Germany | 165/151 |
| 2449145 | 4/1976 | Fed. Rep. of Germany | 165/151 |
| 55-105194 | 8/1980 | Japan | 165/151 |
| 56-97267 | 3/1981 | Japan | 165/151 |
| 2023798 | 1/1980 | United Kingdom | 165/151 |

*Primary Examiner*—Sheldon J. Richter

*Attorney, Agent, or Firm*—Cushman, Darby & Cushman

[57] ABSTRACT

A cross-fin coil type heat exchanger wherein a multiplicity of raised fins of the louver type are formed on the major portion of the surface of a convoluted fin base plate and the area of the portion of the fin base plate reduced in heat transfer performance is minimized, to improve the heat transfer effects achieved by the fins. Means is provided to inhibit the growth of a boundary layer by the front edge effect of the raised fins and promote the conversion of a current of a heat exchange fluid. Ribs are formed in the fins remote from heat transfer tubes to further promote the conversion of the current of the heat exchange fluid into a turbulent flow and also to reinforce the fins. The raised fins of the louver type have a construction that tends itself to good draining, to avoid an increase in the resistance offered to the passage of the current of the heat exchange fluid in wet condition.

7 Claims, 23 Drawing Figures

CROSS-FIN COIL TYPE HEAT EXCHANGER

BACKGROUND OF THE INVENTION

This invention relates to heat exchangers, and more particularly it deals with a heat exchanger of the cross-fin coil type.

In this type of heat exchanger, several proposals have hitherto been made to do work on the surface of each of the fins in various ways to provide improvements in the effects achieved by the fins in transferring heat between the fins and a gaseous heat exchange fluid, such as air. For example, there has been proposed a fin unit comprising a multiplicity of slit fins formed on a fin base plate, each slit fin comprising a fin provided by cutting a fin base plate and raising the material of the plate in bridge form by means of a press while leaving a slit in the base plate where the material has been removed.

Some disadvantages are associated with this type of heat exchanger of the prior art. In the slit fin unit, the slit fins are arranged such that their surfaces are disposed parallel to the direction in which a current of air flows between the slit fin units, so that the slit fins contribute little to rendering the air current turbulent in flow. Additionally limitations are placed on the air current flowing between the fin units by the fin base plate that accounts for the majority of the area and velocity and temperature boundary layers tend to develop on the fin base plate, with a result that the slit fin portions show a high heat transfer performance but the fin base plate is poor in heat transfer performance, particularly in portions of the fin base plate that remain between the slit fins. In applications where the slit fins have a uniform height, the problem is raised that the slit fins in the rear are low in heat exchange efficiency, because the slit fins in the rear are located on the downstream side of the slit fins in the front.

Japanese Patent Application Laid-Open Number 105194/80 (Toshio Hatada, et al.) provides improvements in a fin unit. The fin unit disclosed in this laid-open patent application comprises a multiplicity of fins arranged in stepped fasion with respect to the direction in which an air current flows. The fins are complex in shape and are of the so-called bridge type in which each fin is connected to the fin base plate only at its shorter sides. Thus the fin unit disclosed is not wholly satisfactory because it leaves something to be desired in strength due to the aforesaid construction.

When the fin unit of the prior art is used with an air cooler, condensation formed on the surface of the fin unit tends to turn into droplets of water which block the slits. When this phenomenon takes place, the heat transfer characteristics of the fin unit are greatly reduced. No means is provided to cope with this situation.

SUMMARY OF THE INVENTION

An object of the present invention is to provide a heat exchanger of the cross-fin coil type capable of achieving the transfer of heat with increased efficiency, wherein a multiplicity of louver-type raised fins are formed on the majority of the surface area of a fin unit while minimizing the area of a fin base plate which is reduced in heat transfer performance. By this structural feature, the influences which might otherwise be exerted by the slits in the front on the slits in the rear disposed downstream of the slits in the front can be eliminated, and the development of boundary layers can be inhibited and the conversion of a current of a heat exchange fluid into a turbulent flow can be promoted by the front edge effect of the raised fins.

Another object of the present invention is to provide a heat exchanger of the cross-fin-coil type capable of achieving to the full the effects of the raised fins in increasing the heat transfer performance, to improve the efficiency of the fins and increase the heat transfer rate attributed to air while reducing the resistance offered to the passage of an air current and increasing the strength of the fins. This object can be accomplished by splitting into two portions at least the raised fins remotest from an imaginary line connecting together the centers of apertures (for receiving heat exchange medium tubes) through a fin base plate portion in a direction perpendicular to the direction in which the air current flows, and providing no slits in the side portion of the adjacent heat exchange medium tube which is juxtaposed against the fin base plate portion, to thereby improve the efficiency with which heat is transferred between the raised fins and the heat exchange medium tubes.

Another object of the present invention is to provide a heat exchanger of the cross-fin coil type capable of avoiding an increase in the resistance offered to the passage of an air current when the air is humid by causing the louver type raised fins to drain well while allowing them to greatly increase the effects they achieved in transferring heat. This object can be accomplished by the structural arrangement whereby each of the louver type fins has one longer side thereof increased in length as compared with the other longer side and bent portions of the shorter sides of the raised fins are inclined with respect to the longer sides, so that the longer sides can be oriented vertically when the fin units are assembled.

A further object of the present invention is to provide a heat exchanger of the cross-fin coil type capable of markedly improving its thermal performance by permitting the raised fins to achieve the front edge effect and mixing effect satisfactorily when the air is humid and drain flows down the fin surface. This object can be accomplished by setting the louver gap of the raised fins at a range of values which are high enough to avoid blocking of the louver gap portion by the drain.

A still other object of the present invention is to provide a heat exchanger of the cross-fin-coil type capable of markedly improving its thermal performance by permitting the raised fins to achieve the front edge effect and mixing effect satisfactorily when the air is humid and drain flows down the fin surface. This object can be accomplished by treating the surface of the fin base plate to render same hydrophilic and by setting the gap of the louver type fins at a predetermined range of values which are higher in going to the upper portion of the fins to avoid the phenomenon of the gap portion being blocked by the drain.

A further object of the present invention is to provide a heat exchanger of the cross-fin coil type capable of markedly improving its thermal performance by permitting the raised fins to achieve the front edge effect and mixing effect satisfactorily when the air is humid and drain flows down the fin surface. This object can be accomplished by treating the surface of the fin base plate to render same hydrophilic and at the same time by treating the fin base plate in the vicinity of the upper end of the raised portion of the louver type fins to render same hydrophobic, to avoid the phenomenon of the gap portion being blocked by the drain.

An additional object of the present invention is to provide a heat exchanger of the cross-fin coil type capable of maximizing the louver gap of the louver type raised fins without causing a reduction in performance, to thereby increase the effects achieved in mixing the main current and the branch current of a heat exchange fluid and in promoting the conversion of the flow to one of turbulence. This object can be accomplished by imparting a convoluted form to the fin base plate so that its convolutions are inclined with respect to the direction of flow of an air current and by arranging the louver type fins in such a manner that they are raised and inclined symmetrically at an angle higher than or substantially equal to the angle of inclination of the convolutions of the fin base plate with respect to the direction in which the air current flows.

Additional and other objects, features and advantages of the invention will become apparent from the description set forth hereinafter when considered in conjunction with the accompanying drawings.

DESCRIPTION OF THE PREFERRED EMBODIMENTS

Figure 17:
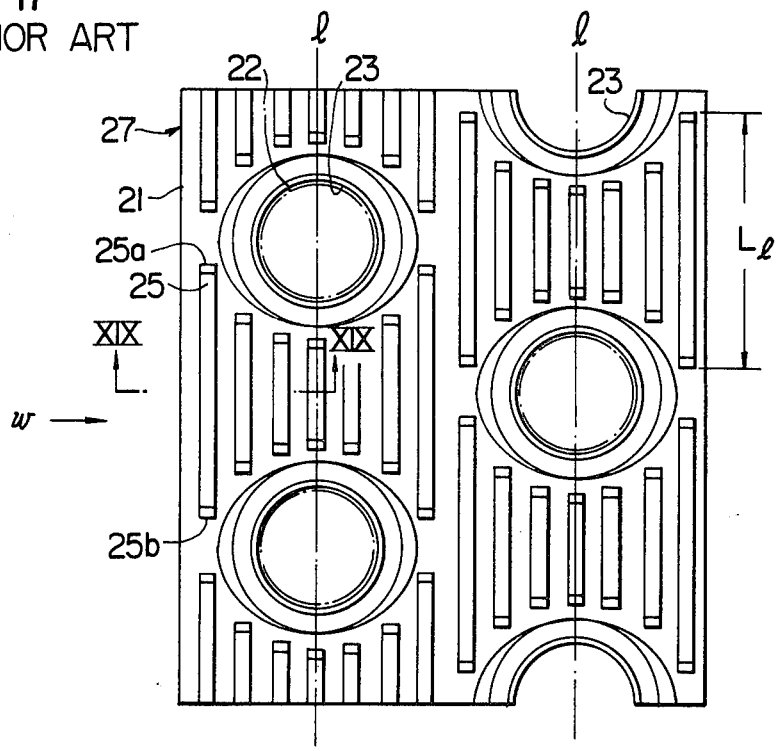
FIG. 17 PRIOR ART
FIG. 17 is a plan view of a fin unit of the prior art.
Figure 18:
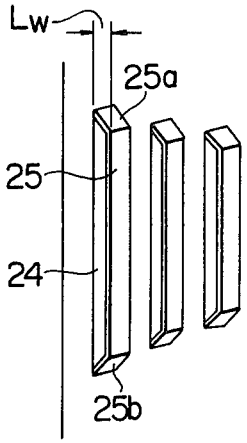
FIG. 18 PRIOR ART
FIG. 18 is a perspective view, on an enlarged scale, of parts of the fin unit shown in FIG. 17.
Figure 19:
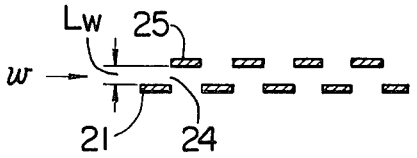
FIG. 19 PRIOR ART
FIG. 19 is a sectional view taken along the line XIX—XIX in FIG. 17.

Before describing the preferred embodiments of the invention, a typical fin unit of the bridge type of the prior art will be outlined by referring to FIGS. 17–19, to enable the invention to be thoroughly understood.

A fin unit 27 comprises a fin base plate 21 of aluminum which is formed with two rows of apertures 23 for inserting heat exchange medium tubes 22 disposed in the front and rear respectively in staggered relation, and a multiplicity of slits 24 of small width substantially parallel to one another and to a straight line l interconnecting the centers of the apertures 23, the slits 24 being located in a manner to surround the apertures 23 by leaving a small area therearound without having the slits. A portion of the fin base plate 21 defined between a pair of slits 24 is raised in bridge form to provide a fin 25 having upper and lower shorter sides 25*a* and 25*b* connected to the fin base plate 21. Thus all the fins 25 are parallel to the plane of the fin base plate 21 and have the same height, and a heat exchange fluid w is supplied in a direction which is parallel to the surface of the fin base plate 21. In this construction, a current of the heat exchange fluid w is not rendered turbulent as much as is desired by the slit fins 25, thereby making it impossible to improve the heat transfer performance satisfactorily.

Figure 1:
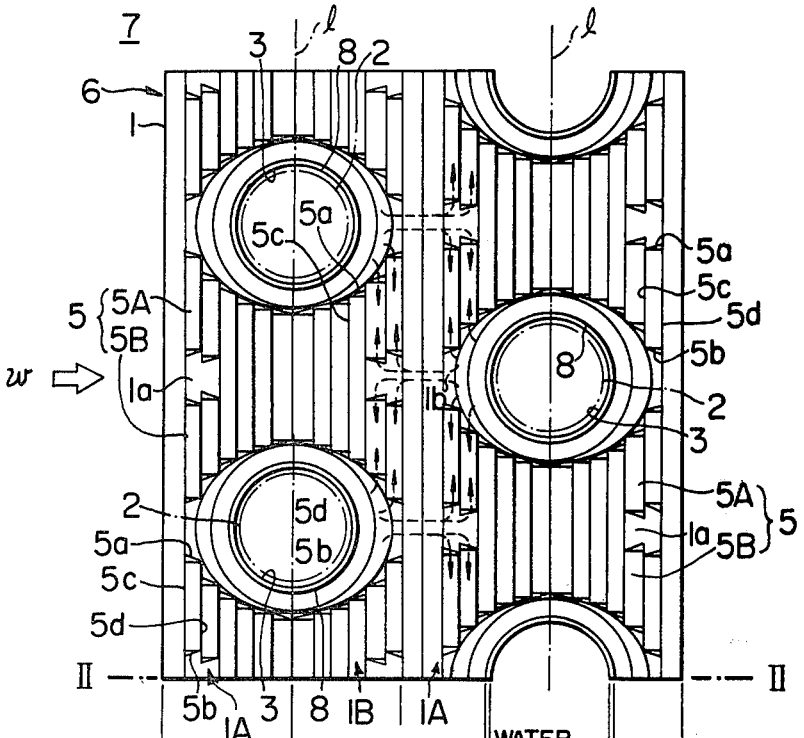
FIG. 1 is a plan view of a fin unit comprising one embodiment of the invention.
Figure 2:
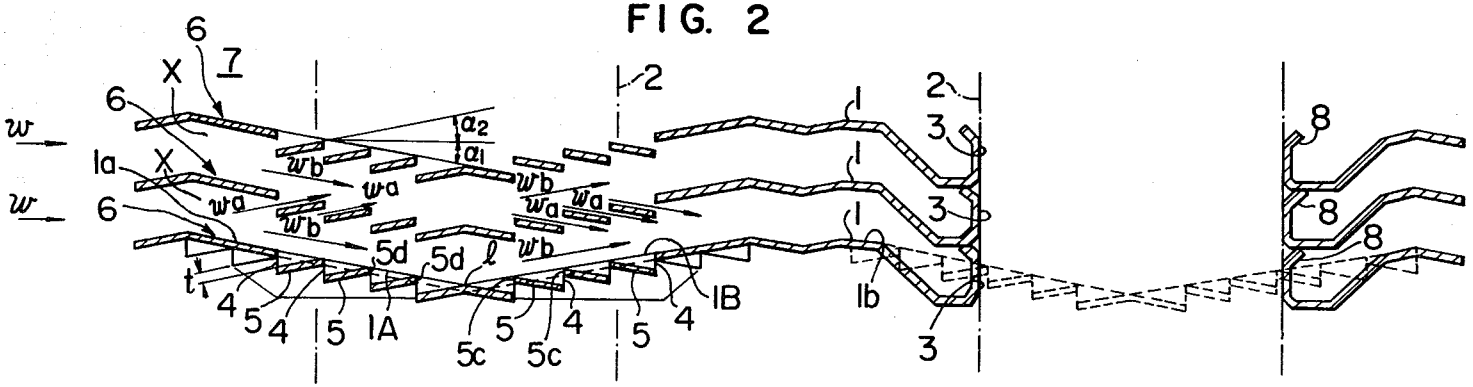
FIG. 2 is a sectional view taken along the line II—II in FIG. 1.

FIGS. 1 and 2 show a cross-fin coil which is one embodiment of the heat exchanger in conformity with the invention, which comprises a multiplicity of heat exchange medium tubes 2, and a multiplicity of fin units 6 attached to the tubes with a predetermined pitch or spacing interval with each other. Each fin unit 6 comprises a fin base plate 1 bent in wave form or in two waves, for example, and formed with apertures 3 for receiving heat exchange medium tubes 2 located on the ridges l of the waves in two rows in the front and rear (left and right in FIG. 1) respectively, with the apertures 3 of the adjacent rows being staggered. The fin base plate 1 is formed substantially on the entire surface thereof with a multiplicity of elongated slits 4 and a multiplicity of louver type raised fins 5 parallel to the ridges l except for a small area of the fin base plate 1 surrounding each aperture 3. A current of a heat exchange fluid w is caused to flow between the fin units 6 of the cross-fin coil 7 in a direction substantially perpendicular to the slits 4 and the raised fins 5. The raised fins 5 are each formed by raising the material of the fin base plate 1 at a predetermined angle of inclination by leaving shorter sides 5*a* and 5*b* connected to the fin base plate 1 while keeping one of longer sides 5*c* and 5*d* supported on the plane of the fin base plate 1. More specifically, as shown in FIG. 2, fin base plate surface portions 1A and 1B are inclined either upwardly or downwardly with respect to the direction in which a current of a heat exchange fluid w flows, and the louver type raised fins 5 are inclined in a direction opposite the direction of inclination of the fin base plate portion 1A or 1B. That is, on the upstream side of the current w with respect to the straight line (ridge) l interconnecting the apertures 3 forming a row, the fins 5 are bent downwardly with the longer sides 5*d* on the downstream side being positioned on the fin base plate surface portion 1A, and on the downstream side thereof, the fins 5 are bent downwardly with the longer sides 5*c* on the upstream side being positioned on the fin base plate surface portion 1B. The louver type raised fins 5 are inclined with respect to the current of the heat exchange fluid w in such a manner that the angle of inclination $\alpha_2$ is substantially equal to or greater than the angle of inclination $\alpha_1$ of the fin base plate surface portions 1A and 1B with respect to the direction of flow of the current of the heat exchange fluid w. Preferably $\alpha_2=2\alpha_1$.

The raised fins 5 are formed substantially on the entire surface of the fin base plate 1 excepting portions thereof that surround the apertures 3, and the length of the raised fins 5 gradually increases in going away from the straight line l (ridge) that interconnects the centers of the apertures 3 arranged in a row. Of all the raised fins 5 forming an array between the apertures 3 arranged in a row, the raised fin 5 remotest from the straight line l and the raised fin 5 next remotest therefrom on either side thereof are each split into an upper raised fin member 5A and a lower raised fin member 5B through a fin base plate portion 1*a* in a direction perpendicular to the direction of flow of the current of the heat exchange fluid w. A side portion 1*b* of the adjacent heat exchange medium tube 2 juxtaposed against the fin base plate portion 1*a* has no slits 4.

Figure 8:
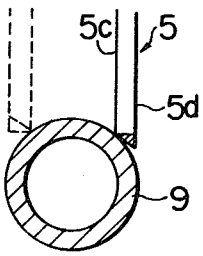
FIG. 8 is a plan view in explanation of the raised fin according to the invention in comparison with a raised fin of the prior art.
Figure 7:
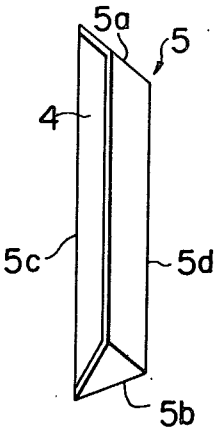
FIGS. 6 and 7 are a plan view and a perspective view, on an enlarged scale, respectively of the fin unit shown in FIG. 1.
Figure 6:
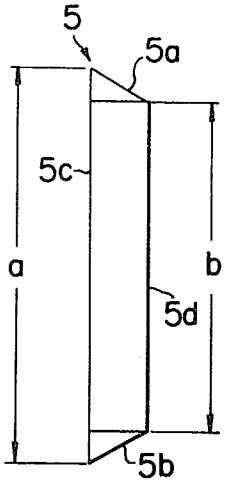

The raised fins 5 are trapezoidal in planar configuration so that the upstream longer side 5*c* has a greater length than the downstream longer side 5*d* on the upstream of the straight line l (ridge) and that the downstream longer side 5*d* has a greater length than the upstream longer side 5*c* on the downstream of the straight line l. Thus, as best shown in FIGS. 6–8, bent portions of the upper and lower shorter sides 5*a* and 5*b* are inclined with respect to the longer sides 5*c* and 5*d* respectively, so that when the longer sides 5*c* and 5*d* are oriented vertically, the bent portions of the shorter sides 5*a* and 5*b* are inclined obliquely upwardly and downwardly respectively. The numeral 8 designates a collar formed around each aperture 3.

In the embodiment shown and described hereinabove, a multiplicity of slits 4 and raised fins 5 are formed on the fin base plate 1 with only parts thereof in the vicinity of the apertures 3 having neither slits 4 nor fins 5. By this structural arrangement, each fin unit 6 has enough strength to be fitted over and supported by the heat exchange medium tubes 2 and yet it is possible to markedly increase the effects achieved by the fin unit 6 in transferring heat, because the portions of the fin base plate 1 low in heat transfer performance are greatly reduced in area and the raised fins of high heat transfer performance account for the majority of the area of the fin base plate 1.

In addition, of all the raised slits 5 forming an array between the apertures 3 for receiving the heat transfer medium tubes 2, the raised fin 5 remotest from the straight line l interconnecting the centers of the apertures 3 and the raised fin 5 next remotest therefrom on either side thereof are each split into the upper raised fin member 5A and the lower raised fin member 5B through the fin base plate portion 1*a* in a direction perpendicular to the direction in which the current of the heat exchange fluid w flows, and no slits 4 are formed in the side portion 1*b* of the heat exchange medium tube 2 (tube of the second row) juxtaposed against the fin base plate portion 1*a*. Thus the raised fin members 5A and 5B each have a reduced longitudinal length and the heat supply passageway is reduced. At the same time, as indicated by arrows in FIG. 1, the raised fins 5 close to the heat exchange medium tubes 2 of the first row and the side portion 1*b* close to the heat exchange medium tube 2 of the second row receive thermal streams transmitted thereto from the heat exchange medium tubes 2 of the first row and the heat exchange medium tubes 2 of the second row through the upper and lower shorter sides 5*a* and 5*b* of the raised fin members 5A and 5B respectively. Thus heat exchange can take place efficiently between the raised fin members 5A and 5B and the heat exchange medium tubes 2, with a result that the raised fin members 5A and 5B can exhibit to the full the high heat transfer performance thereof. Thus the efficiency with which the fins function can be improved, and the heat transfer coefficient attributed to the air can be increased. Also, by splitting the raised fins 5 into the raised fin portions 5A and 5B, it is possible to reduce the resistance offered to the passage of the current of heat exchange fluid w, such as air and at the same time to increase the strength of the edge portion of each raised fin 5. This is conducive to prevention of collapsing down of the fins during production of the bent coils.

As shown in FIG. 2, a current of a heat exchange fluid w flowing through a fluid passageway X defined between the fin units 6 includes a main current $w_a$ made to pass by the raised fins 5 through the slits 4 upwardly in a curved flow on the upstream side of the straight line l and downwardly in a curved flow on the downstream side thereof, and a branch current $w_b$ that passes straight between the fin units 6 so that the main current $w_a$ and the branch current $w_b$ impinge against each other and are mixed together to allow the current w to flow in vortical form. As a whole, the current w flows in wave form with the main current $w_a$ first forming an upper layer and then forming a lower layer while the branch current $w_b$ first forming a lower layer and then forming an upper layer as it flows along the convoluted fin base plate 1, so that the current w flows in turbulent flow in which the main current $w_a$ and the branch current $w_b$ are vigorously mixed to promote the growth of turbulence of the current w as a whole. This is conducive to a marked increase in the heat transfer coefficient of the heat exchanger between the heat exchange medium w and the fin units 6.

The absence of the raised fins 5 on the downstream side of the main current $w_a$ that has passed between the raised fins 5 eliminates the influences which would otherwise be exerted by the front raised fin 5 on the raised fin 5 of the downstream side. Thus all the raised fins 5 can exhibit excellent heat transfer performance, thereby increasing the effects achieved in transferring heat by the heat exchanger.

Since the raised fins 5 are raised from the fin base plate 1, the raised fins 5 according to the invention can achieve the effect of cutting a boundary layer like the slit fins of the prior art, thereby increasing the heat transfer rate.

The arrangement whereby the raised fins 5 of the louver type are inclined as they are raised in a direction opposite to the direction in which the convolutions of the fin base plate 1 are inclined with respect to the direction of flow of the heat exchange fluid w enables a louver gap t to be increased in size without increasing the width of the raised fins 5 (or without reducing the number of the raised fins 5), to thereby further promote conversion of the current w into a turbulent flow by the actions of the main current $w_a$ and the branch current $w_b$ mixing with each other.

If the angle of inclination of the raised fins 5 of the louver type or $\alpha_2$ is smaller than the angle of inclination of the convolutions of the fin base plate 1 or $\alpha_1$, the louver gap t would become small, making it impossible to accomplish the desired effects. Meanwhile if $\alpha_2$ were larger than $\alpha_1$, the louver gap t would become large but the resistance offered to the current of the heat exchange medium w would also increase. This is not desirable for a heat exchanger. Preferably $\alpha_2=2\alpha_1$.

The arrangement whereby the raised fins 5 surround each aperture 3 (or the heat exchange medium tube 2) the current of the heat exchange fluid w is guided by the upper and lower shorter sides 5*a* and 5*b* of the raised fins 5 at the inclined bent portions thereof to change its direction and flow along the heat exchange medium tube 2. Thus the current flows smoothly and the resistance offered to its flow is minimized, thereby further improving the heat transfer performance.

The arrangement whereby the convolutions of the fin base plate 1 have their ridges disposed parallel to the slits 4 and the apertures 3 for inserting the heat exchange medium tubes 2 are formed along the ridges increases the strength of the fin base plate 1. This eliminates the trouble of the deformation of the fin base plate 1 that might otherwise occur when the tubes 2 are expanded.

As aforesaid, in the embodiment shown and described herein, the raised fins 5 are inclined as they are raised in a direction opposite to the direction in which the convolutions of the fin plate 1 are inclined with respect to the direction of flow of the heat exchange fluid w. Thus mountain-shaped ribs facing a direction opposite to the direction in which the convolutions of the fin base plate 1 face are formed on the ridges of the convolutions of the fin base plate 1, thereby increasing greatly the bend strength of the fin unit in the longitudinal direction.

Figure 20:
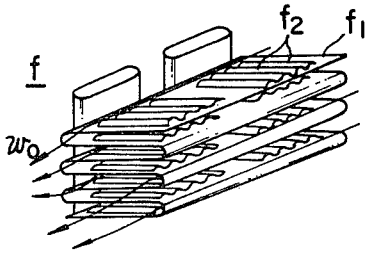
FIG. 20 PRIOR ART
FIG. 20 is a fragmentary perspective view of a radiator of an automotive vehicle of the prior art.

Louver fins have been used to provide corrugated fins f for use with radiators of automotive vehicles as shown in FIG. 20. In this type of corrugated fins f, raised fins of the louver type $f_2$ are formed in a series by forming a row on a fin base plate $f_1$, so that a bypass air current $w_o$ is formed and flows along a bend of the fin base plate $f_1$. By contrast, no bypass air current is produced in the heat exchanger according to the invention in the vicinity of each heat exchange medium tube 2 because of the arrangement that the heat exchange medium tubes 2 arranged in parallel rows are staggered with respect to the tubes 2 of the adjacent row. Thus the aforesaid effects can be achieved more satisfactorily.

The raised fins 5 need not be constant in width (width of the shorter sides). Preferably the width is not constant, to further the tendency of the air current being made to flow in turbulence.

As shown in FIGS. 6 and 7, each raised fin 5 is trapezoidal in its planar configuration so that one longer side 5*c* (or 5*d*) is longer than the other longer side 5*d* (or 5*c*), and the bend portions of the upper and lower shorter sides 5*a* and 5*b* are inclined obliquely upwardly and downwardly respectively. By virtue of this structural feature, the lower bent portion can drain well when water droplets adhere to the fin unit as it is used with a heat exchanger for cooling air, so that the trouble can be avoided that the slits 4 are blocked by the water droplets and the resistance offered to the passage of the air current increases.

The arrangement whereby each raised fin 5 is trapezoidal in planar configuration increases the area of the fin by an amount corresponding to a hatched zone as shown in FIG. 8, as compared with a raised fin of the prior art which is rectangular in planar configuration as shown in broken lines. This is conducive to increased heat transfer performance. In FIG. 8, the numeral 9 designates a portion of the fin base plate 1 serving as a keep allowance when the raised fin 5 is formed that cannot be worked into a fin.

Since the raised fins 5 of the aforesaid construction are located to surround each aperture 3 (or each heat exchange medium tube 2), a current of the heat exchange fluid w is guided by the inclined bent portions of the upper and lower shorter sides 5*a* and 5*b* of the raised fin 5 to change its direction of flow and flows along the heat exchange medium tube 2. Thus the air current flows smoothly, so that it is possible to improve the heat transfer performance by minimizing the resistance offered to the passage of the air current.

Figure 3:
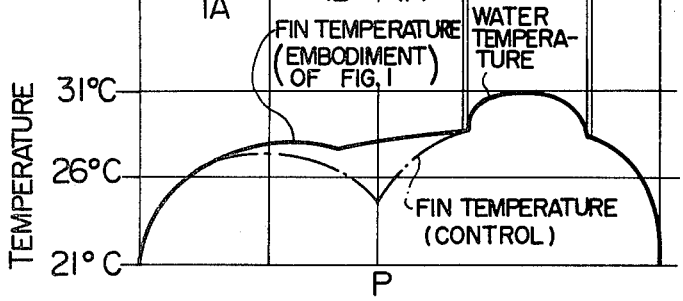
FIG. 3 is a diagram showing the results of tests conducted to determine the temperature distribution on the surface of the fin unit shown in FIG. 1.

Experiments were conducted on the embodiment of the fin unit 6 in conformity with the invention shown in FIG. 1 having two raised fins 5, one remotest and the other next remote from the straight line l, disposed on either side of the line l, split each into two raised fin members, under the following conditions: air velocity, Va=1 m/sec; air temperature, $t_\infty=21°$ C.; and hot water temperature in the heat transfer medium tubes $t_w=31°$ C. In the experiments, the surface temperature distribution in the position of the line II—II was tested in comparison with that in the same position of a fin unit, used as a control, which has no split raised fins. The results of the experiments are shown in FIG. 3. It will be seen that in the control indicated by a broken line the temperature gradient shows a sudden discontinuity in a portion P corresponding to the slit edges remotest from the straight line l and the surface temperature shows a sudden drop in this portion. On the other hand, in the embodiment of the invention represented by a solid line, there is no development of discontinuity in the temperature gradient and the surface temperature shows a marked rise, particularly in the portion P (where the split raised fins are present), as compared with the surface temperature of the control, indicating that the fin efficiency is greatly increased.

Figure 4:
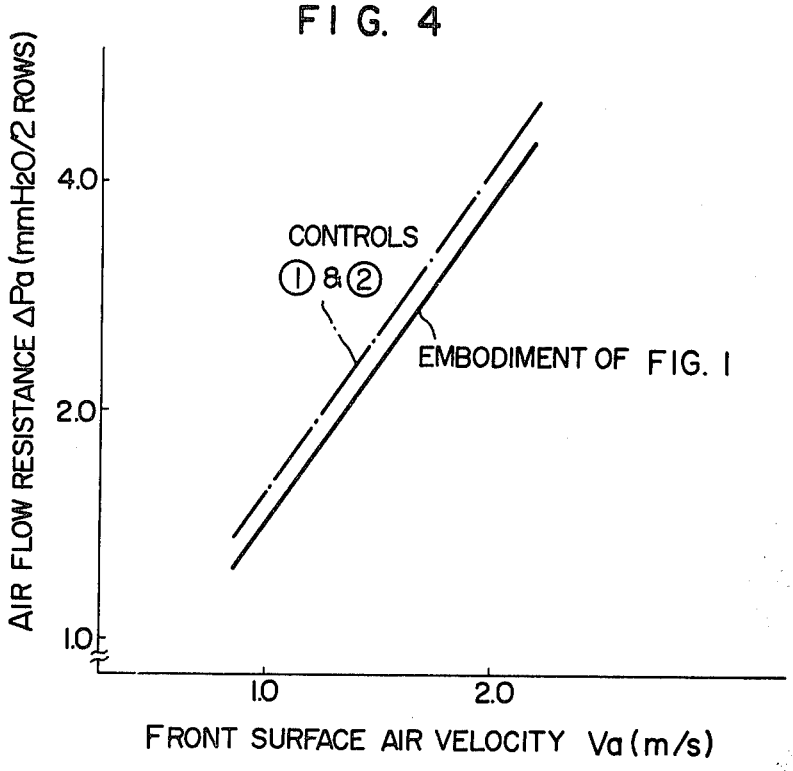
FIGS. 4 and 5 are diagrams showing the results of tests conducted on the resistance offered to the passage of an air current and the heat transfer coefficient attributed to the air side with respect to the wind velocity at the front surface.
Figure 5:
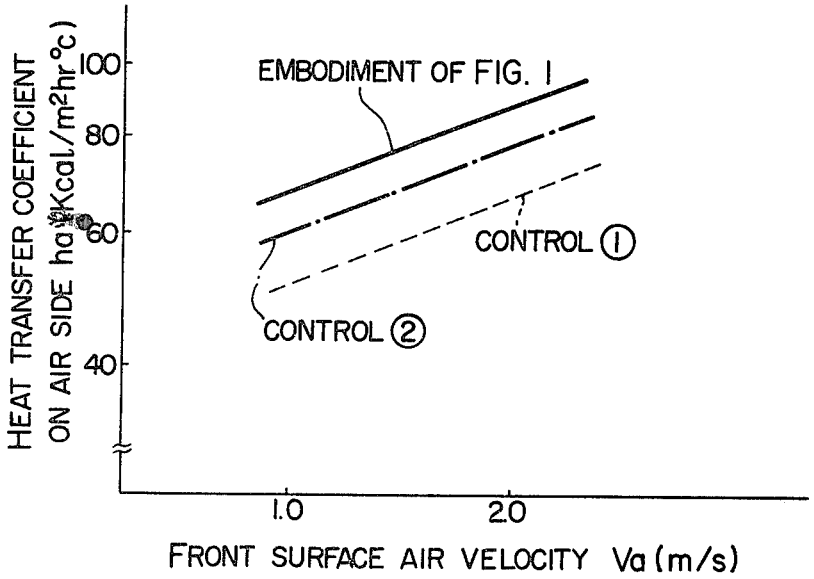

Tests were conducted to measure the resistance offered to the passage of an air current Δpa (mmH2O/Two rows) and the heat transfer coefficient attributed to the air ha (kcal/m$^2$h·°C.) with respect to the front surface air velocity Va (m/s), by using the embodiment of the invention, the conventional fin unit shown in FIG. 17 as a control 1 and a fin unit which has the similar construction as that of the embodiment of FIG. 1 but has no split raised fins, as a control 2. FIGS. 4 and 5 show the results obtained. It will be seen that the resistance offered to the passage of the air current pa is reduced by 5% in the embodiment of the invention as compared with the controls 1 and 2, and the heat transfer coefficient attributed to the air ha in the embodiment of the invention is increased by 35% as compared with the control 1 and by 13% as compared with the control 2.

In the embodiment shown and described hereinabove, the heat exchange medium tubes 2 are shown as being circular. It is to be understood that the invention is not limited to this specific form of the heat exchange medium tubes 2 and that any tubes, whether elliptic or flat, may be used so long as they have a major axis in the direction of flow, to achieve increased heat transfer performance by minimizing the resistance offered to the passage of an air current.

In the embodiment shown and described hereinabove, it is the raised fin 5 remotest from the straight line l and the raised fin 5 next remotest therefrom that are each split into two raised fin members. What is important is that the effects achieved by the invention can be achieved if at least the remotest raised fin 5 from the center line l on either side thereof is split into two raised fin members.

Figure 15A:
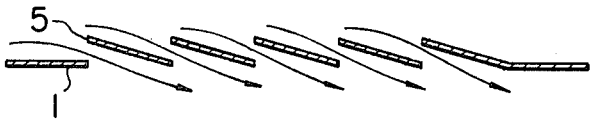
FIGS. 15A and 15B show a dry coil and a wet coil, respectively, of louver type fins, FIG. 15B showing the manner in which a water film is formed.
Figure 15B:
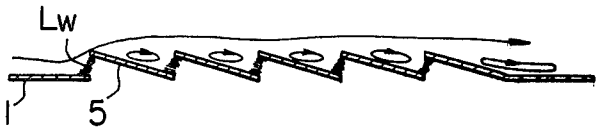

We have found that when the slit fin unit 6 of the invention shown in FIGS. 1 and 2 are used to provide a heat exchanger serving as an air cooler (wet coil), the moisture content of the air flows on the surface of each fin and the fin surfaces are drained. This phenomenon repeatedly takes place and the behavior of the drain exerts great influences on the heat exchange performance and the resistance offered to the passage of an air current. When the heat exchanger is used as a wet coil, the drain forms a water film in the louver gap Lw of the raised slit fin 5 shown in FIGS. 15A and 15B, so that the louver gap Lw is blocked and no air current flows therethrough. When this takes place, the front edge effect and the mixing effect of the raised fins 5 cannot be achieved and the thermal performance of the heat exchanger is greatly deteriorated. When a heat exchanger is used as a dry coil (in which no drain is produced and the fin surface is in dry condition), it may exhibit an excellent performance, but not all the heat exchangers showing an excellent performance in dry condition can achieve the same result when used as a wet coil.

Figure 9A:
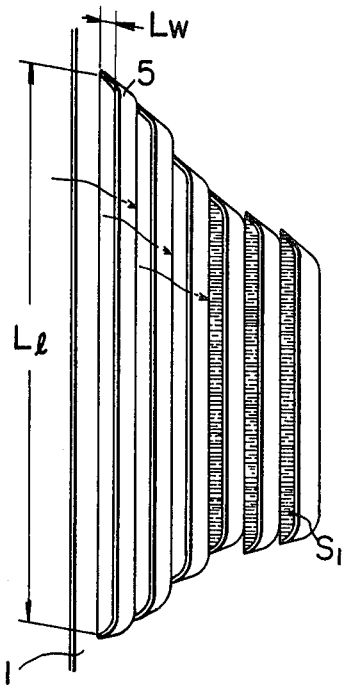
FIGS. 9A and 9B are perspective views in explanation of the manner in which drain water is deposited on the gap portion of the louver of the louver type raised fin when the surface of the fin is hydrophilic, as viewed from the surface side and the undersurface side respectively.
Figure 9B:
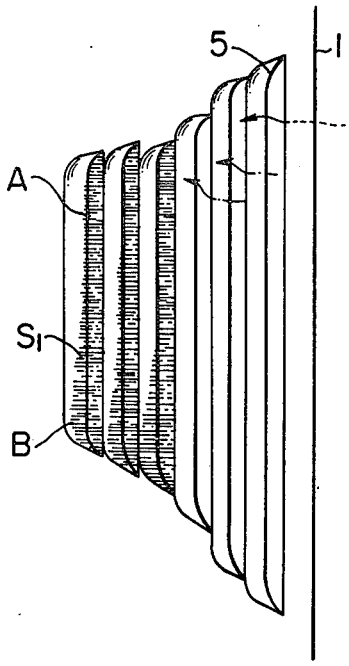

In order to investigate into the cause of deposition of the water droplets on the louver gap Lw of the raised fin 5, we have carried out observations of the mechanism of formation of the water droplets and their drain therefrom by using a wet fin viewing system. The results obtained in the investigation includes the following:

(a) On a hydrophilic surface, the moisture content of the air forms a thin film of water of the surface of the fin base plate 1 as shown in FIGS. 9A and 9B and drained. The drain is deposited on the louver gap Lw to block same.

(b) On a hydrophobic surface, the moisture content of the air forms condensation on the surface of the fin base plate 1. When the condensation grows into drops of a certain size, they drop on to the louver gap Lw to be deposited therein in superposed relation. When this occurs, the drain may form a thin film that entirely blocks the louver gap Lw as is the case with the hydrophilic surface, but only a lower portion B of the louver gap Lw is obtained in many instances.

(c) On both hydrophilic and hydrophobic surfaces, the larger the louver gap Lw, the more difficultly the blocking of the louver gap Lw occurs. On hydrophilic surface, the length $L_1$ is an important factor concerned in the blocking phenomenon. The larger the length $L_1$, the more difficultly the blocking phenomenon occurs.

Based on the results of the observations carried out by us, the cause of the blocking phenomenon has been studied and the following findings have been revealed:

a. In the Case of Hydrophilic Surfaces

As shown in FIG. 9B, the water film $S_1$ in an upper portion A of the louver gap Lw is distinct in width from that in a lower portion B thereof. That is, the width of the water film $S_1$ is smaller in the upper portion A than in the lower portion B. This makes the concave curvature of the water film $S_1$ greater in the upper portion A than in the lower portion B. Generally formation of a concave surface on the surface of a liquid produces a difference in pressure between the liquid and its surroundings due to the surface tension, the differential pressure varying in value in proportion to the curvature. The difference in concave curvature between the upper portion A and the lower portion B causes a difference to be produced in the internal pressure of the water film $S_1$, so that the weight of the water film $S_1$ and the pressure differential due to surface tension balance and the water film $S_1$ is stably present in the louver gap Lw.

Figure 14:
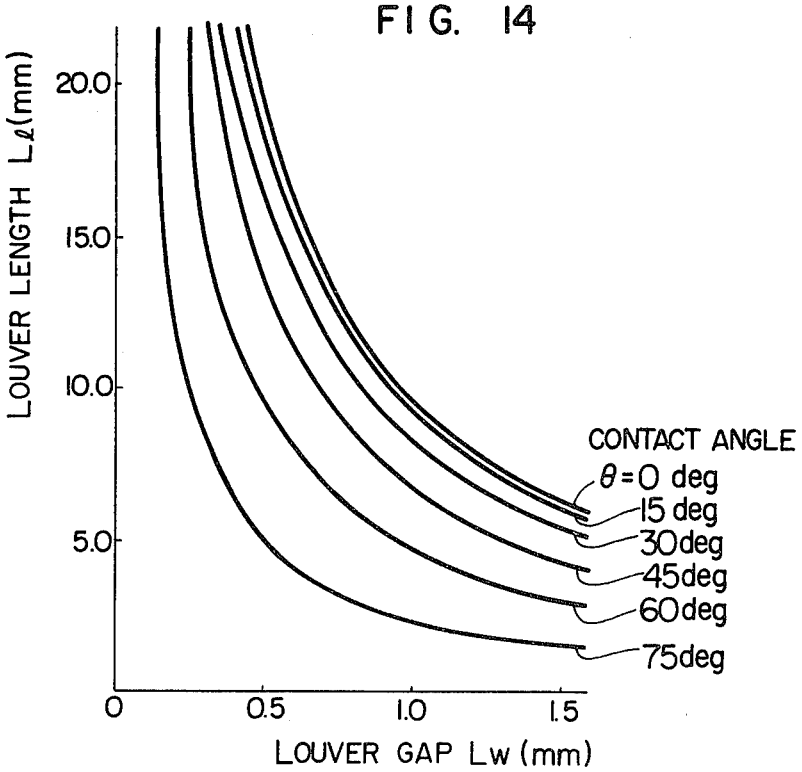
FIG. 14 is a diagram showing the water film stable existence limit line of the louver gap portion.

In view of the findings set forth hereinabove, at attempt was made to obtain a boundary line that allows a water film $S_1$ to be present stably in the louver gap Lw. Such boundary line is shown in FIG. 14 in which it is indicated that when the point determined by the louver gap Lw and the louver length $L_1$ is located in a range higher than the boundary line no water film $S_1$ exists and that when such point is located in a range lower than the boundary line a water film $S_1$ is stably in existence. It will be seen in the figure that in an application in which the contact angle $\theta=0$ deg and Lw=0.5 mm, $L_1$ should have a value of over 19 mm to avoid the blocking phenomenon, and $L_1$ has only to have a value of over 9.5 mm when Lw=1.0 mm.

b. In the Case of Hydrophobic Surfaces

Figure 10A:
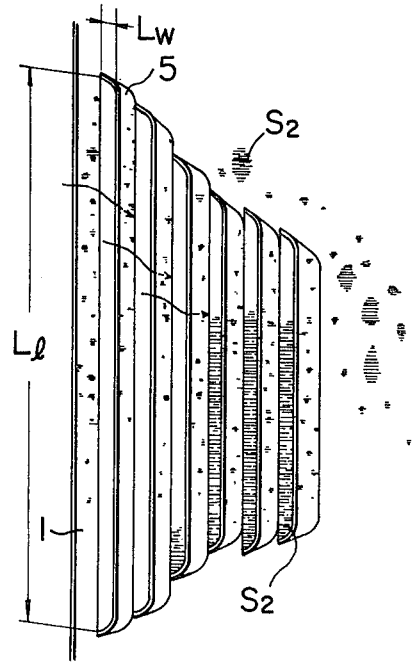
FIGS. 10A and 10B are views corresponding to FIGS. 9A and 9B but when the fin surface is hydrophobic.
Figure 10B:
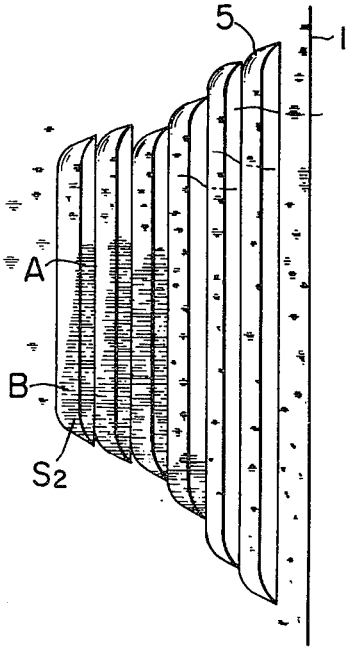

As shown in FIG. 10B, a water droplet $S_2$ of a large vertical length may be deposited on the lower portion B of the louver gap Lw. This phenomenon is grasped as a question of the falling angle of liquid drops placed on a tilting surface, and it is common knowledge that (i) the liquid drops most difficultly fall in the vicinity of the contact angle of 50 deg, that (ii) the larger the liquid drops in size, the more readily they drop, and that (iii) the smaller the liquid drops in width, the more readily they drop.

It will be seen that, since the water drops $S_2$ may vary in size depending on the louver gap Lw, the larger the louver gap Lw, the more readily fall the water drops and more difficultly occurs the blocking phenomenon, and that, since the width of the water drop $S_2$ is determined by the louver width $L_o$, the smaller the louver width $L_o$, the more difficultly occurs the blocking phenomenon.

In view of the findings set forth hereinabove, the following conclusions have been reached:

A. On a hydrophilic surface on which prospective drain is deposited in the form of a thin film, the blocking phenomenon tends to be caused by the drain when the surface is more hydrophilic, the louver length $L_1$ is smaller, and the louver gap Lw is smaller.

B. On a hydrophobic surface on which prospective drain is deposited in the form of liquid drops, the blocking phenomenon tends to be caused by the drain when the louver width $L_o$ is larger and the louver gap Lw is smaller, when the contact angle on the surface is in the vicinity of 50 deg.

To sum up, it will be seen that on both hydrophilic and hydrophobic surfaces an increase in the louver gap Lw in size has the effect of avoiding the phenomenon of the louver gap Lw being blocked by the drain.

To this end, in the embodiment shown and described hereinabove, the louver gap Lw of the raised fin 5 has its value set in a predetermined range of large values to avoid the occurrence of the phenomenon of the louver gap being blocked by the drain. By this arrangement, it is possible for the raised fins 5 to achieve to the full the front edge effect and the mixing effect in wet condition in which the drain flows down the surfaces of the fins, to thereby markedly improve the thermal performance. The raised fins 5 are fabricated such that when the louver length $L_1$ is 5 mm$\leqq L_1 \leqq$20 mm, the louver gap Lw is in the range 0.65 mm$\leqq$Lw$\leqq$0.81 mm, preferably in the range 0.68 mm$\leqq$Lw$\leqq$0.72 mm.

Figure 11:
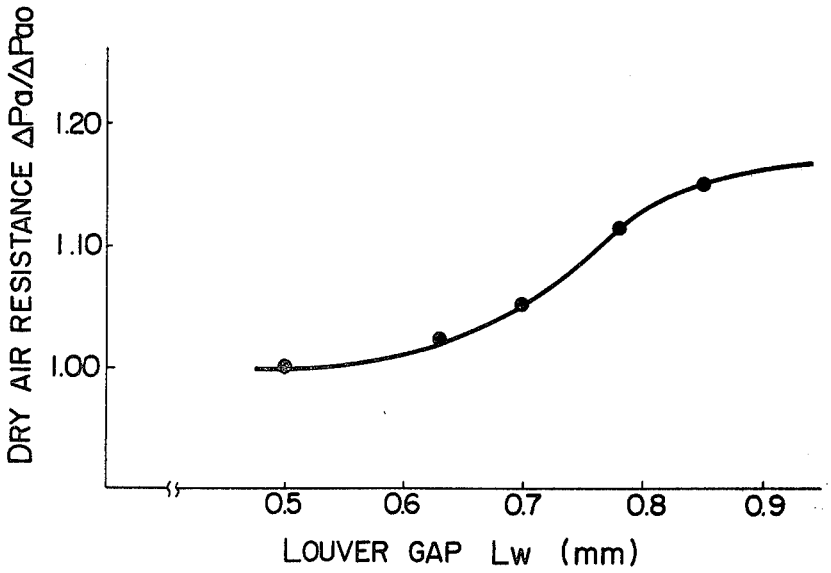
FIG. 11 is a diagram showing the results of experiments conducted on the resistance offered to the passage of a dry air current by the louver gap.
Figure 12:
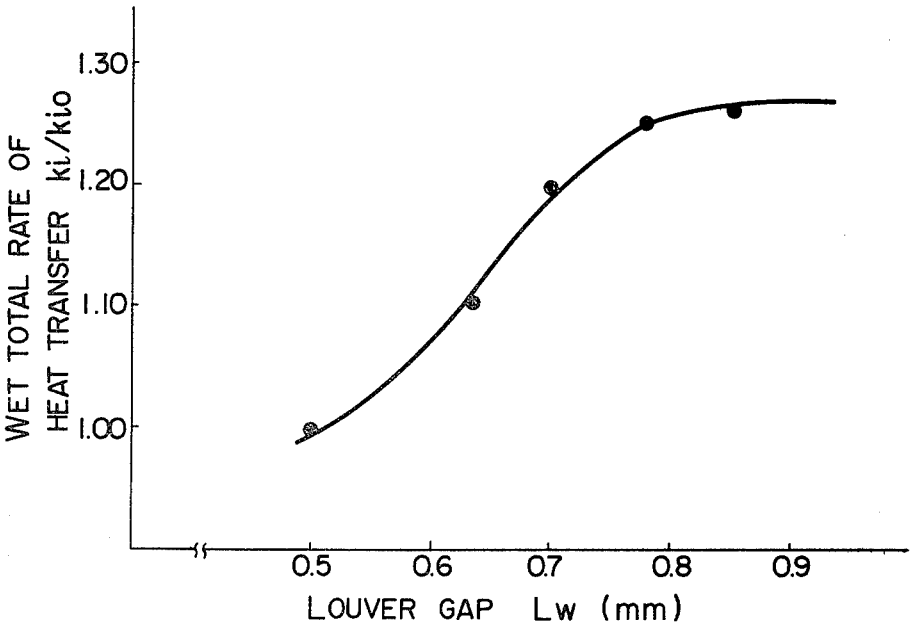
FIG. 12 is a diagram showing the results of experiments conducted on the humid air total heat transfer rate with respect to the louver gap.

The range of the values for the louver gap Lw of the raised fins 5 will now be discussed. Tests on the performance (dry air resistance, wet total rate of heat transfer, dry rate of heat transfer) of the heat exchanger according to the invention was conducted by varying the louver gap Lw when the louver length $L_1$ is in the range 5 mm$\leqq L_1 \leqq$20 mm. The results obtained are shown in FIGS. 11 and 12. FIG. 11 shows the ratio of dry air resistance $\Delta Pa/\Delta Pao$ to the louver gap Lw with a front surface air velocity Va=1 m/s, and FIG. 12 shows the ratio of wet total rate of heat transfer ki/kio to the louver gap Lw. In both figures, the value Lw=0.5 mm is used as a reference for obtaining the ratios of different values.

Figure 13:
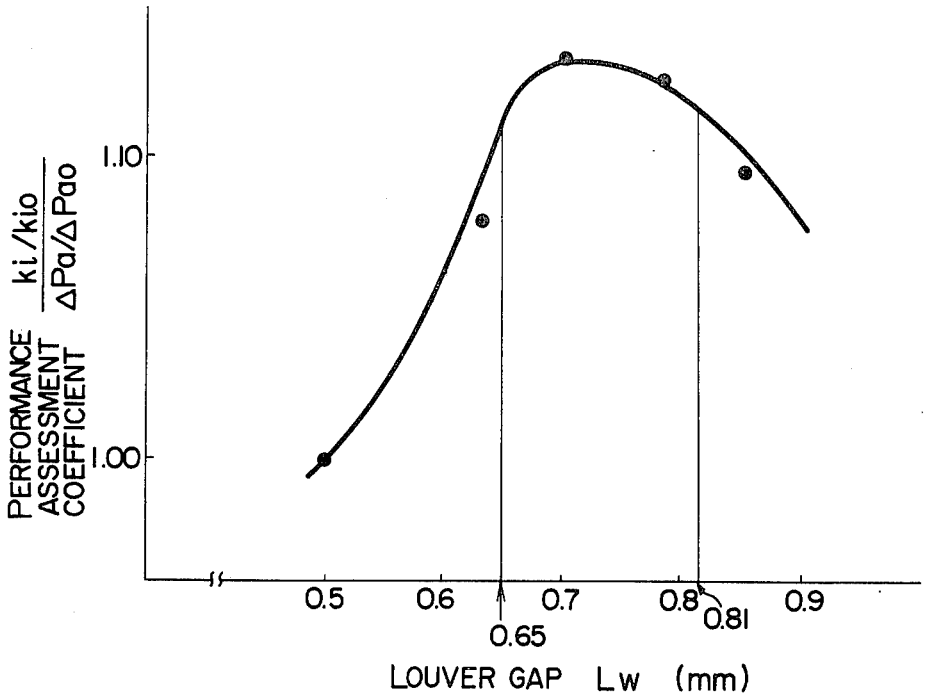
FIG. 13 is a diagram showing the results of experiments on the performance assessment coefficient with respect to the louver gap.

In FIG. 12, it will be seen that the wet total heat transfer rate ratio ki/kio becomes larger as the louver gap Lw increases, and in FIG. 11 it will be seen that the dry air resistance ratio $\Delta Pa/\Delta Pao$ becomes larger as the louver gap Lw increases. The results of the experiments show that the dry heat transfer rate is not appreciably influenced by the louver gap Lw. The wet total rate of heat transfer was divided by the dry air resistance and the value obtained was used as a performance assessment coefficient. FIG. 13 shows the results of the calculation. In the figure, it will be seen that the performance assessment coefficient (ki/kio)/($\Delta Pa/\Delta Pao$) is maximized when Lw=0.7 mm and that the performance improves by over 10% when the louver gap is in the range 0.65 mm$\leqq$Lw$\leqq$0.81 mm as compared with the performance shown when the louver gap Lw=0.5 mm. This range is preferred. The most preferred range is 0.68 mm$\leqq$Lw$\leqq$0.72 mm in which the value is substantially equal to the maximum value 1.13.

Thus by setting the louver gap Lw of the raised fins 5 at a value in the range 0.65 mm$\leqq$Lw$\leqq$0.81 mm with the louver length $L_1$ in the range of 5 mm$\leqq L_1 \leqq$20 mm, it is possible to avoid the occurrence of the blocking phenomenon in which the deposits of drain on the louver gap Lw of each raised fin 5 obturate the louver gap Lw. The result of this is that the raised fins 5 are able to achieve the front edge effect and the mixing effect satisfactorily even in wet condition, and the heat transfer rate can be improved by 20–30% as compared with the raised fins with the louver gap Lw having deposits of drain, so that the thermal performance can be markedly improved.

In the aforesaid embodiment, the entire surface of the fin unit is rendered either hydrophilic or hydrophobic, and the louver gap Lw of each raised fin 5 of the louver type is constant in value lengthwise thereof. Further research into the cause of deposition of drain on the louver gap Lw has revealed the following findings.

A water film adheres to the surfaces of fins of a slit fin unit or a louver type fin unit when the wetting force of a water film formed in the vicinity of the upper end of the rise portion of each fin and the gravity of the water droplets themselves balance, with a result that the water film adhering phenomenon occurs in the louver gap Lw. Thus, (1) the smaller the rise gap Lw, the larger is the concave curvature of the upper end of the water film and the greater is the composite of the wetting force, and (2) the smaller the length $L_1$ of the rise portion of each fin, the lighter is the weight of the water film. When this situation is introduced, the water film adheres to the rise gap Lw and obturation of the gap occurs.

It is impossible to infinitely increase the length $L_1$ of the fins, so that it is desirable to reduce the wetting force of the water film formed in the vicinity of the upper end of the rise gap Lw. To this end, it is advantageous to treat the surface of the fin base plate to render same hydrophilic and to set the value of the gap of each louver type fin at a range of higher values in its upper portion while at the same time treating the portion of the fin base plate in the vicinity of the upper portion of each raised fin to render same hydrophobic.

Figure 16:
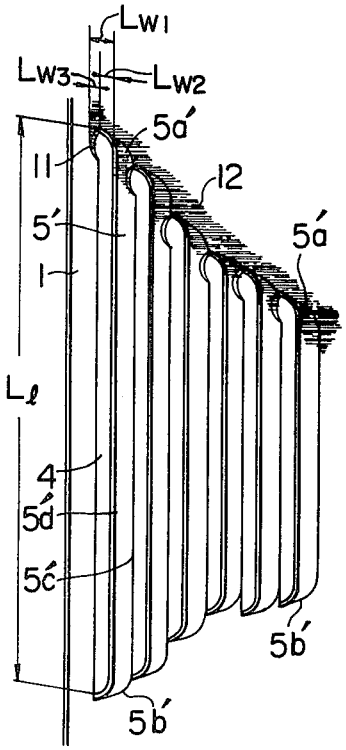
FIG. 16 shows another embodiment in which the gap in the upper portion is larger than the gap in the lower portion.

Another embodiment of the invention in which the aforesaid findings are incorporated is shown in FIG. 16 which shows louver type fins 5' on an enlarged scale. The louver type fins 5' of this embodiment which are formed in the same construction as the louver type fins 5 shown in FIGS. 1 and 2 are distinct from the embodiment shown in FIG. 1 in that a recess 11 is formed in the fin base plate 1 in the vicinity of the base of the shorter side 5'*a* at the upper end of each fin 5'. The provision of the recess 11 in the vicinity of the base of the shorter side 5'*a* results in a rise gap $L_{w1}$ having the same dimension as a rise gap $L_{w2}$ with no recess plus a depth $L_{w3}$ of the recess 11. Thus the slit gap is increased by an amount corresponding to the depth $L_{w3}$ of the recess 11 at the upper end of the rise portion of each louver type fin.

The fin base plate 1 is treated in the vicinity of the base of the shorter side 5'*a* of each fin at its surface and undersurface to render same hydrophobic as indicated at 12, and the rest of the fin base plate 1 is treated to render same hydrophilic. By this treatment, the surface and the undersurface of the fin base plate 1 in the vicinity of the upper end of each rise fin are prevented from being wetted unlike the surface treated to render same hydrophilic, and the water droplets are readily drained upon growing to a certain size, so that the phenomenon of obturation of the gap by the water film can be avoided more effectively.

As material for treating the fin base plate 1 to render same hydrophilic, an interface activating agent, such as coloidal silica, polyoxyethylene glycol, phenol ether, etc., is used. Polytetrafluoroethylene, polydimethylsiloxane (silicon resin) or polypropylene may be used for treating the fin base plate to render same hydrophobic. An aluminum sheet that is not treated may be used as a fin base plate.

When the fin base plate is treated to render same hydrophilic and a heat exchanger using such base plates is used as an air cooler, the surface of each fin would be wetted and a water film formed in the vicinity of the upper end of the rise portion of each louver type fin 5' wound have a high wetting force, thereby causing the rise gap Lw to be obturated by a thin film of water. However, in the invention, the treatment given to the surface and the undersurface of the fin base plate 1 in the vicinity of the upper shorter side 5'*a* of each fin 5' to render same hydrophobic as indicated at 12 and the provision of the recess 11 thereto have the effect of preventing the surface and undersurface of the fin base plate in the vicinity of the upper end of each rise fin from being wetted unlike the surface treated to render same hydrophilic. The water droplets are readily drained upon growing to a certain size, so that no water film adheres to the rise gap $L_w$ at the upper end of the rise portion of each fin 5'. Even if some water droplets rest on the lower portion of the rise gap $L_w$, they would be blown off by the air current and the phenomenon of the rise gap as a whole being blocked by a water film can be prevented.

Thus the heat exchanger provided by the invention can achieve excellent effects in transferring heat, because the raised fins, such as of the louver type, can achieve to the full the front edge effect and the effect of rendering an air current turbulent even in wet condition, to thereby improve the rate of heat transfer.

What is claimed is:

1. A heat exchanger comprising:

fin units (6) each comprising a convoluted fin base plate (1) which is formed with a multiplicity of apertures (3) arranged parallel to the ridges of the convolutions in a plurality of rows with the apertures (3) of the adjacent rows being staggered, a multiplicity of slits (4) of a small width arranged parallel to a straight line 1 interconnecting the centers of the apertures (3) of the same row and substantially parallel to one another in a manner to surround the aperture (3) with no slits being formed in the vicinity of each aperture (3), and a multiplicity of louver type raised fins (5) formed by raising the material adjacent to one slit in such a manner that in each raised fin (5) two shorter sides (5*a* and 5*b*) on the side of the apertures (3) are connected to the fin base plate (1) and one of longer sides (5*c* and 5*d*) is held on the surface of the fin base plate (1); and a multiplicity of heat exchange medium tubes (2) each inserted in the surfaces of apertures (3) of a plurality of said fin units (6) to provide a cross-fin coil;

wherein said raised fins (5) are successively formed without a base plate portion between the adjacent raised fins (5) and with each fin having a planar surface inclined with respect to the surface of the fin base plate (1);

wherein a current of air (w) is caused to flow between the fin units (6) of the cross-fin coil (7) in a direction substantially perpendicular to the slits (4), and the convolutions of each said fin base plate (1) are inclined with respect to the direction of flow of the air current (w) while said raised fins (5) are raised and inclined in a direction opposite to the direction of inclination of the convolutions of the fin base plate (1); and wherein said raised fins (5) except the raised fins (5) formed in each portion between the adjacent apertures (3) of each said row are each split into two raised fin members through a fin base plate portion (1*a*) in a direction perpendicular to the direction of flow of the air current (w), and no slits (4) are formed in the side portion (1*b*) of the adjacent heat exchanger medium tube (2) juxtaposed against the fin base plate portion (1*a*).

2. A heat exchanger as claimed in claim 1, wherein one of said longer sides (5*c* or 5*d*) of each said raised fin (5) has a greater length than the other longer side (5*d* or 5*c*) and each of said shorter sides (5*a* and 5*b*) of each said raised fin (5) is inclined substantially in the direction of the adjacent aperture (3) so as to surround the aperture, and wherein said fin units (6) are arranged such that the longer sides of each said raised fin (5) are oriented vertically.

3. A heat exchanger as claimed in claim 1, wherein each said raised fin (5) has a louver length ($L_1$) of 5 mm$\leqq L_1 \leqq$20 mm and a louver gap ($L_w$) of 0.65 mm$\leqq L_w \leqq$0.81 mm.

4. A heat exchanger as claimed in claim 1, wherein said raised fins (5) are raised and inclined in a direction opposite to the direction of inclination of the convolutions of the convoluted fin base plate (1) with respect to the direction of flow of the air current (w) in such a manner that the angle of inclination $\alpha_2$ of the raised fins (5) is substantially equal to or greater than the angle of inclination $\alpha_1$ of the convolutions of the convoluted fin base plate (1) or $\alpha_2 \geqq \alpha_1$.

5. A heat exchanger as claimed in claim 1, wherein mountain-shaped ribs are formed in the ridges of the convolutions of the convoluted fin base plate (1) and oriented in a direction opposite to the direction of inclination of the convolutions of the convoluted fin base plate (1).

6. A heat exchanger comprising:

fin units (6) each comprising a convoluted fin base plate (1) which is formed with a multiplicity of apertures (3) arranged parallel to the ridges of the convolutions in a plurality of rows with the apertures (3) of the adjacent rows being staggered, a multiplicity of slits (4) of a small width arranged parallel to a straight line l interconnecting the centers of the apertures (3) of the same row and substantially parallel to one another in a manner to surround the aperture (3) with no slits being formed in the vicinity of each aperture (3), and a multiplicity of louver type raised fins (5) formed by raising the material adjacent to one slit in such a manner that in each raised fin (5) two shorter sides (5*a* and 5*b*) on the side of the apertures (3) are connected to the fin base plate (1) and one of longer sides (5*c* and 5*d*) is held on the surface of the fin base plate (1); and a multiplicity of heat exchange medium tubes (2) each inserted in the surfaces of apertures (3) of a plurality of said fin units (6) to provide a cross-fin coil (7);

wherein a current of air (w) is caused to flow between the fin units (6) of the cross-fin coil (7) in a direction substantially perpendicular to the slits (4), and the convolutions of each said fin base plate (1) are inclined with respect to the direction of flow of the air current (w) while said raised fins (5) are raised and inclined in a direction opposite to the direction of inclination of the convolutions of the fin base plate (1); and wherein at least the raised fins (5) remotest from said straight line l are each split into two raised fin members through a fin base plate portion (1*a*) in a direction perpendicular to the direction of flow of the air current (w), and no slits (4) are formed in the side portion (1*b*) of the adjacent heat exchanger medium tube (2) juxtaposed against the fin base plate portion (1*a*), said cross-fin coil (7) being arranged such that said slits (4) are oriented vertically, and wherein each said louver type fin (5') has on the side of its upper shorter side (5'*a*) a rise gap ($L_{w1}$) which is greater than the rise gap ($L_{w2}$) thereof on the side of its lower shorter side (5'*b*).

7. A heat exchanger comprising:

fin units (6) each comprising a convoluted fin base plate (1) which is formed with a multiplicity of apertures (3) arranged parallel to the ridges of the convolutions in a plurality of rows with the apertures (3) of the adjacent rows being staggered, a multiplicity of slits (4) of a small width arranged parallel to a straight line l interconnecting the centers of the apertures (3) of the same row and substantially parallel to one another in a manner to surround the aperture (3) with no slits being formed in the vicinity of each aperture (3), and a multiplicity of louver type raised finds (5) formed by raising the material adjacent to one slit in such a manner that in each raised fin (5) two shorter sides (5*a* and 5*b*) on the side of the apertures (3) are connected to the fin base plate (1) and one of longer sides (5*c* and 5*d*) is held on the surface of the fin base plate (1); and a multiplicity of heat exchange medium tubes (2) each inserted in the surfaces of apertures (3) of a plurality of said fin units (6) to provide a cross-fin coil (7);

wherein a current of air (w) is caused to flow between the fin units (6) of the cross-fin coil (7) in a direction substantially perpendicular to the slits (4), and the convolutions of each said fin base plate (1) are inclined with respect to the direction of flow of the air current (w) while said raised fins (5) are raised and inclined in a direction opposite to the direction of inclination of the convolutions of the fin base plate (1); and wherein at least the raised fins (5) remotest from said straight line l are each split into two raised fin members through a fin base plate portion (1*a*) in a direction perpendicular to the direction of flow of the air current (w), and no slits (4) are formed in the side portion (1*b*) of the adjacent heat exchanger medium tube (2) juxtaposed against the fin base plate portion (1*a*), said cross-fin coil (7) being arranged such that said slits (4) are oriented vertically, and wherein the surface of the fin base plate (1) in the vicinity of the upper shorter side (5'*a*) of each said louver type fin (5') is treated to render same hydrophobic while the rest of the surface of the fin base plate (1) is treated to render same hydrophilic.

* * * * *